US007670733B2

(12) United States Patent
Wu et al.

(10) Patent No.: US 7,670,733 B2
(45) **Date of Patent: *Mar. 2, 2010**

(54) SILANOL CONTAINING PHOTOCONDUCTORS

(75) Inventors: Jin Wu, Webster, NY (US); Francisco J. Lopez, Rochester, NY (US); Linda L. Ferrarese, Rochester, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 348 days.

This patent is subject to a terminal disclaimer.

(21) Appl. No.: 11/796,661

(22) Filed: Apr. 27, 2007

(65) Prior Publication Data

US 2008/0268356 A1 Oct. 30, 2008

(51) Int. Cl.
*G03G 5/04* (2006.01)

(52) U.S. Cl. ..... 430/57.2; 430/58.8; 430/59.4; 430/59.5

(58) Field of Classification Search ..... 430/57.2, 430/58.8, 59.4, 59.5
See application file for complete search history.

(56) References Cited

U.S. PATENT DOCUMENTS

| | | | | |
|---|---|---|---|---|
| 5,473,064 | A | 12/1995 | Mayo et al. | |
| 5,482,811 | A | 1/1996 | Keoshkerian et al. | |
| 5,521,306 | A * | 5/1996 | Burt et al. | 540/141 |
| 2008/0014517 | A1 * | 1/2008 | Wu et al. | 430/58.2 |

OTHER PUBLICATIONS

Jin Wu et al., U.S. Appl. No. 11/485,645 on Silanol Containing Photoconductors, filed Jun. 12, 2006.

Jin Wu et al., U.S. Appl. No. 11/485,550 on Silanol Containing Photoconductors, filed Jun. 12, 2006.

* cited by examiner

*Primary Examiner*—John L Goodrow
(74) *Attorney, Agent, or Firm*—E. O. Palazzo

(57) ABSTRACT

A photoconductor containing an optional supporting substrate, a photogenerating layer, and at least one charge transport layer comprised of at least one charge transport component, and wherein the photogenerating layer contains a Type V hydroxygallium phthalocyanine having incorporated therein a silanol.

30 Claims, No Drawings

SILANOL CONTAINING PHOTOCONDUCTORS

CROSS REFERENCE TO RELATED APPLICATIONS

U.S. Pat. No. 7,560,206 on Silanol Containing Photoconductors, the disclosure of which is totally incorporated herein by reference.

Illustrated in U.S. Pat. No. 7,541,122 on Silanol Containing Photoconductors, the disclosure of which is totally incorporated herein by reference, is an imaging member comprising an optional supporting substrate, a photogenerating layer, and at least one charge transport layer comprised of at least one charge transport component, and at least one silanol.

A number of the appropriate components and amounts thereof of the above copending applications, such as the supporting substrates, resin binders, photogenerating layer components, antioxidants, charge transport components, hole blocking layer components, adhesive layers, and the like may be selected for the members of the present disclosure in embodiments thereof.

BACKGROUND

This disclosure is generally directed to layered imaging members, photoreceptors, photoconductors, and the like. More specifically, the present disclosure is directed to multilayered flexible, belt imaging members, and rigid drum photoconductors comprised of an optional supporting medium like a substrate, a hydroxygallium containing photogenerating layer, and a charge transport layer, including a plurality of charge transport layers, such as a first charge transport layer and a second charge transport layer, an optional adhesive layer, an optional hole blocking or undercoat layer, and an optional overcoating layer, and wherein at least one of the charge transport layers contains at least one charge transport component, a polymer or resin binder, and an optional antioxidant. The photoconductors illustrated herein, in embodiments, have excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the photoconductors disclosed herein possess excellent, and in a number of instances low $V_r$ (residual potential), and allow the substantial prevention of $V_r$ cycle up when appropriate, high sensitivity; low acceptable image ghosting characteristics, low background and/or minimal charge deficient spots (CDS), and desirable toner cleanability. More specifically, there is illustrated herein in embodiments the formation of Type V hydroxygallium in the presence of suitable silanols. At least one in embodiments refers, for example, to one, to from 1 to about 10, to from 2 to about 7; to from 2 to about 4, to two, and the like.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 5,473,064, the disclosure of which is totally incorporated herein by reference, a process for the preparation of hydroxygallium phthalocyanine which comprises the hydrolysis of a halogallium phthalocyanine precursor, like Type I chlorogallium phthalocyanine, to a hydroxygallium phthalocyanine like Type I, and conversion of the resulting hydroxygallium phthalocyanine to Type V hydroxygallium phthalocyanine by contacting the resulting hydroxygallium phthalocyanine with an organic solvent; and wherein the precursor halogallium phthalocyanine is obtained by the reaction of gallium halide with diiminoisoindolene in an organic solvent. More specifically, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

There is illustrated in U.S. Pat. No. 5,482,811, the disclosure of which is totally incorporated herein by reference, a process for the preparation of hydroxygallium phthalocyanines which comprises hydrolyzing a gallium phthalocyanine precursor pigment by dissolving said hydroxygallium phthalocyanine in a strong acid, and then reprecipitating the resulting dissolved pigment in basic aqueous media, removing any ionic species formed by washing with water, concentrating the resulting aqueous slurry comprised of water and hydroxygallium phthalocyanine to a wet cake, removing water from said slurry by azeotropic distillation with an organic solvent, and subjecting said resulting pigment slurry to mixing with the addition of a second solvent to cause the formation of said hydroxygallium phthalocyanine polymorphs.

There is illustrated in U.S. Pat. No. 5,521,306, the disclosure of which is totally incorporated herein by reference, a process for the preparation of Type V hydroxygallium phthalocyanine which comprises the in situ formation of an alkoxy-bridged gallium phthalocyanine dimer, hydrolyzing the alkoxy-bridged gallium phthalocyanine dimer to hydroxygallium phthalocyanine, and subsequently converting the hydroxygallium phthalocyanine product obtained to Type V hydroxygallium phthalocyanine.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,921,769, the disclosure of which is totally incorporated herein by reference, there are illustrated photoconductive imaging members with blocking layers of certain polyurethanes.

The appropriate components, and processes of the above recited patents may be selected for the present disclosure in embodiments thereof.

SUMMARY

Disclosed are photoconductors with many of the advantages illustrated herein, such as extended lifetimes of service of, for example, in excess of about 1,000,000 imaging cycles; excellent electronic characteristics; stable electrical properties; low image ghosting; low background and/or minimal charge deficient spots (CDS); resistance to charge transport layer cracking upon exposure to the vapor of certain solvents; excellent surface characteristics; excellent wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photo-Induced Discharge Curve), and the like.

Also disclosed are layered photoresponsive imaging members, which are responsive to near infrared radiation of from about 700 to about 900 nanometers.

Further disclosed are layered photoresponsive imaging members with sensitivity to visible light.

Additionally disclosed are imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

Also disclosed are layered photoreceptors which exhibit low or minimal CDS; and the prevention of $V_r$ cycle up, caused primarily by photoconductor aging, for numerous imaging cycles.

EMBODIMENTS

Aspects of the present disclosure relate to an imaging member comprising an optional supporting substrate, a photogenerating layer, and at least one charge transport layer comprised of at least one charge transport component, and wherein the photogenerating layer contains a hydroxygallium phthalocyanine generated in the presence of a silanol and a solvent, such as DMF (dimethylformamide), from Type I hydroxygallium phthalocyanine, and wherein the silanol is selected, for example, from the group comprised of at least one of the following formulas/structures

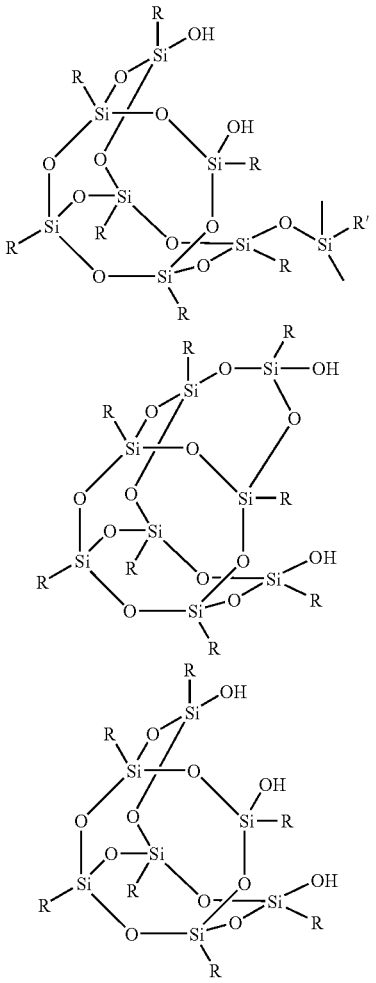

-continued

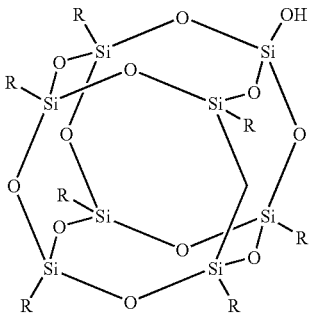

and wherein R and R' are independently selected from the group consisting of alkyl, alkoxy, aryl, and substituted derivatives thereof, and mixtures thereof; an imaging member comprising a supporting substrate, a photogenerating layer, and at least two charge transport layers wherein the photogenerating layer contains a hydroxygallium phthalocyanine generated in the presence of a silanol and a solvent from Type I hydroxygallium phthalocyanine, which silanols can also be referred to as polyhedral oligomeric silsesquioxane (POSS) silanols

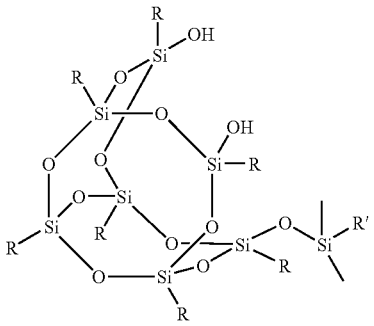

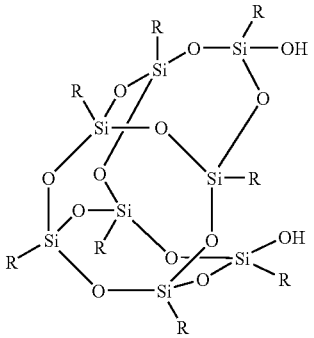

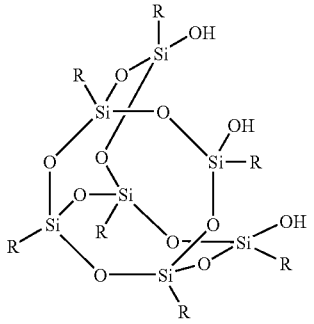

-continued

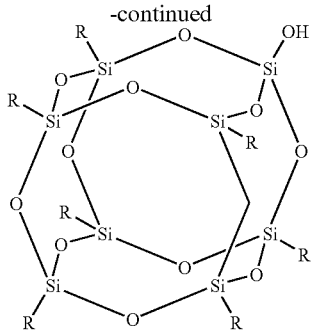

wherein R and R' are independently selected from the group comprised of a suitable hydrocarbon, such as alkyl, alkoxy, aryl, and substituted derivatives thereof, and mixtures thereof with, for example, from 1 to about 36 carbon atoms like phenyl, methyl, vinyl, allyl, isobutyl, isooctyl, cyclopentyl, cyclohexyl, cyclohexenyl-3-ethyl, epoxycyclohexyl-4-ethyl, fluorinated alkyl such as $CF_3CH_2CH_2$— and CF3$(CF_2)_5$ $CH_2CH_2$—, methacrylolpropyl, norbornenylethyl, and the like, and also wherein the R group includes phenyl, isobutyl, isooctyl, cyclopentyl, cyclohexyl, and the like; desired the R' group includes methyl, vinyl, fluorinated alkyl, and the like; an imaging member comprising a supporting substrate, a photogenerating layer thereover wherein the photogenerating layer contains a hydroxygallium phthalocyanine generated in the presence of a silanol and a solvent from Type I hydroxygallium phthalocyanine, and at least one charge transport layer comprised of at least one charge transport component, and wherein the silanol component substituent is, for example, a vinyl, allyl, isobutyl, isooctyl, cyclopentyl, cyclohexyl, cyclohexenyl-3-ethyl, epoxycyclohexyl-4-ethyl, fluorinated alkyl such as $CF_3CH_2CH_2$— and $CF_3(CF_2)_5$ $CH_2CH_2$—, methacrylolpropyl, or norbornenylethyl; a photoconductive member comprised of a substrate, a photogenerating layer thereover wherein the photogenerating layer contains a hydroxygallium phthalocyanine Type V generated in the presence of a silanol, and a solvent from Type I hydroxygallium phthalocyanine at least one to about three charge transport layers thereover, a hole blocking layer, an adhesive layer wherein in embodiments the adhesive layer is situated between the photogenerating layer and the hole blocking layer; a photoconductor comprising an optional supporting substrate, a photogenerating layer, and at least one charge transport layer comprised of at least one charge transport component, and wherein said photogenerating layer contains a Type V hydroxygallium phthalocyanine having incorporated therein a silanol; a photoconductor wherein said charge transport component is comprised of aryl amines of the formulas

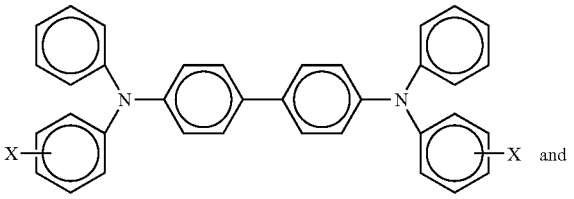

and

-continued

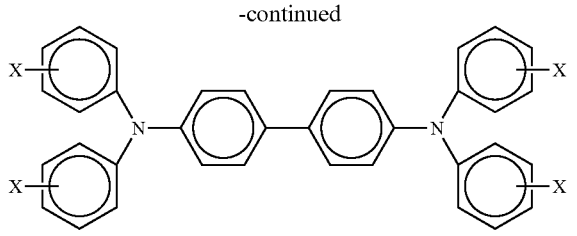

wherein X is selected from the group consisting of alkyl, alkoxy, aryl, and halogen; and a photoconductor wherein said charge transport component is comprised of aryl amines of the formulas

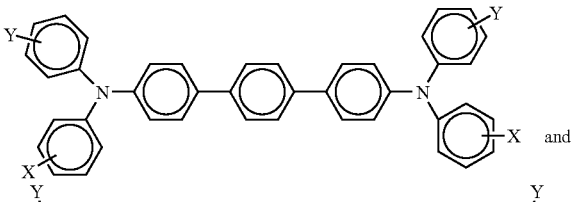

and

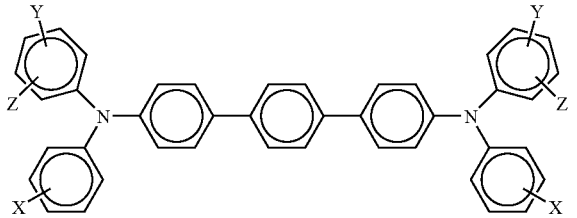

wherein X, Y and Z are independently selected from the group consisting of alkyl, alkoxy, aryl, and halogen.

There is disclosed a photoconductive imaging member comprised of a supporting substrate, a photogenerating layer thereover, a charge transport layer, and an overcoating charge transport layer; a photoconductive member with a photogenerating layer of a thickness of from about 0.1 to about 10 microns, at least one transport layer each of a thickness of from about 5 to about 100 microns; a xerographic imaging apparatus containing a charging component, a development component, a transfer component, and a fixing component; and wherein the apparatus contains a photoconductive imaging member comprised of a supporting substrate, and thereover a layer comprised of a photogenerating pigment and a charge transport layer or layers, and thereover an overcoating charge transport layer, and where the transport layer is of a thickness of from about 20 to about 75 microns; a member wherein the silanol, or mixtures thereof is present in an amount of from about 0.1 to about 40 weight percent, or from about 2 to about 10 weight percent; a member wherein the photogenerating layer contains the Type V photogenerating pigment present in an amount of from about 10 to about 95 weight percent; a member wherein the thickness of the photogenerating layer is from about 0.2 to about 4 microns; a member wherein the photogenerating layer contains an inactive polymer binder; a member wherein the binder is present in an amount of from about 5 to about 90 percent by weight, and wherein the total of all layer components is about 100 percent; a member wherein the photogenerating component is a silanol-modified hydroxygallium phthalocyanine Type V that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating layer resinous binder is selected from the group consisting of known suitable polymers like polyesters, copolymers of vinyl chloride and vinyl acetate, polyvinyl chloride-co-vinyl acetate-co-maleic acid, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers, especially a first and second layer, comprises

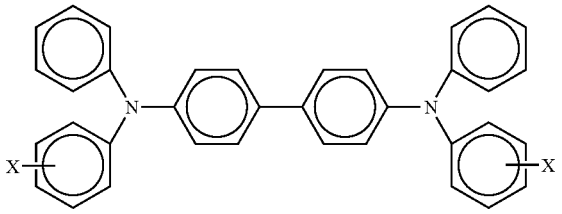

wherein X is selected from the group consisting of alkyl, alkoxy, and halogen, such as methyl and chloride; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each of or at least one of the charge transport layers, especially a first and second charge transport layer, comprises

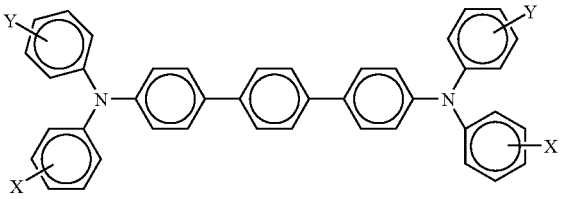

wherein X and Y are independently alkyl, alkoxy, aryl, a halogen, or mixtures thereof; an imaging member wherein, for example, alkyl and alkoxy contains from about 1 to about 15 carbon atoms; alkyl contains from about 1 to about 5 carbon atoms; and wherein the resinous binder is selected from the group consisting of polycarbonates and polystyrene; an imaging member wherein the photogenerating pigment present in the photogenerating layer is comprised of a silanol-modified Type V hydroxygallium phthalocyanine prepared by hydrolyzing a gallium phthalocyanine precursor by dissolving the chlorogallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent and a silanol to cause the formation of the silanol-modified hydroxygallium phthalocyanine Type V; an imaging member wherein the silanol-modified hydroxygallium phthalocyanine Type V has major peaks, as measured with an X-ray diffractometer, at Bragg angles (2θ±0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport; a member wherein the charge transport layer is situated between the substrate and the photogenerating layer, and wherein the number of charge transport layers is 2; a member wherein the photogenerating layer is of a thickness of from about 0.1 to about 10 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the photogenerating layer is from about 0.5 to about 5 microns; a member wherein the photogenerating and charge transport layer components are contained in a polymer binder; a member wherein the binder is present in an amount of from about 50 to about 90 percent by weight, and wherein the total of the layer components is about 100 percent; wherein the photogenerating layer resinous binder is selected from the group consisting of polyesters, copolymers of vinyl chloride and vinyl acetate, polyvinyl chloride-co-vinyl acetate-co-maleic acid, polyvinyl butyrals, polycarbonates, polystyrene-b-polyvinyl pyridine, and polyvinyl formals; an imaging member wherein the photogenerating component is silanol-modified hydroxygallium phthalocyanine Type V, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine molecules, and wherein the hole transport layer resinous binder is selected from the group consisting of polycarbonates, polyarylates, and polystyrenes; an imaging member wherein the photogenerating layer contains a metal free phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer and a top overcoating layer in contact with the hole transport layer, or in embodiments, in contact with the photogenerating layer, and in embodiments wherein a plurality of charge transport layers are selected, such as for example, from 2 to about 10, and more specifically, 2 may be selected; and a photoconductive imaging member comprised of an optional supporting substrate, a photogenerating layer, and a first, second, and third charge transport layer.

In embodiments thereof the hydroxygallium phthalocyanine mixture, such as Type V, can be prepared by incorporating a hydrophobic silanol into the conversion process from Type I hydroxygallium phthalocyanine or during the milling of the Type I hydroxygallium phthalocyanine, and where the Type V containing photoconductor obtained exhibits a number of advantages, such as lower CDS/background as compared to a similar photoconductor where the hydroxygallium phthalocyanine is generated in the absence of a silanol. The hydrophobic silanols (Si—OH) are stable as a result of the proclivity of most Si—OH groups to eliminate water and form siloxane (Si—O—Si) linkages due to the hindered structures at the other three bonds attached to the silicon. These silanols are stable with long shelf lives. The bonding between the silanol group of the hydrophobic silanol and the metal atom of the phthalocyanine is strong and of ionic nature.

The soluble trisilanolphenyl POSS, or phenyl-POSS trisilanol ($C_{42}H_{38}O_{12}Si_7$) of the following formula/structure

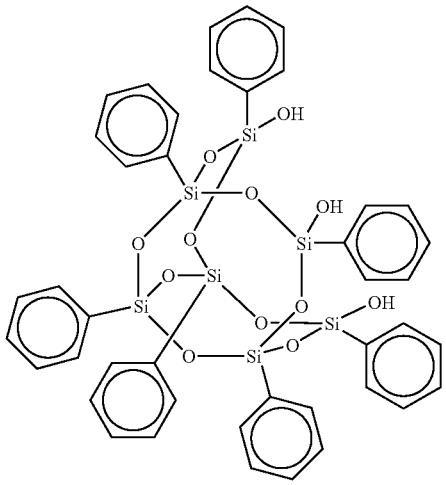

can be physically incorporated into the conversion from Type I to Type V in a solvent such as DMF. After washing and drying, the resulting Type V pigment is usually obtained as a hydrophobic silanol-modified hydroxygallium phthalocyanine as determined by X-ray powder diffraction (XRPD) and nuclear magnetic resonance (NMR) spectra analysis.

The Type I hydroxygallium phthalocyanine can be generated by known methods, such as those illustrated in the relevant patents referenced herein, and more specifically, by the reaction of gallium chloride with 1,3-diiminoisoindolene in certain solvents like n-methylpyrrolidone, or the reaction of a mixture of phthalonitrile and gallium chloride with a chloronaphthalene solvent to form Type I; and wherein Type V hydroxygallium phthalocyanine is converted from the prepared Type I hydroxygallium phthalocyanine in the presence of a silanol, and in embodiments the preparation of hydroxygallium phthalocyanine polymorphs which comprises the synthesis of a halo, especially chlorogallium phthalocyanine, hydrolysis thereof, and conversion in the presence of a silanol of the hydroxygallium phthalocyanine Type I obtained to Type V hydroxygallium phthalocyanine. In embodiments, preparation of the precursor pigment halo, especially chlorogallium phthalocyanine Type I, can result in photogenerating pigments, specifically hydroxygallium phthalocyanine Type V with very low levels of chlorine of, in embodiments, less than about 1 percent, and more specifically, from about 0.05 to about 0.80 percent. The hydroxygallium and chlorogallium phthalocyanines can be identified by various known means including X-ray powder diffraction (XRPD).

In embodiments, the preparation of the precursor halo, especially chlorogallium phthalocyanine, can be accomplished by the reaction of a halo, especially chlorogallium, with diiminoisoindolene and an organic solvent like N-methylpyrrolidone, followed by washing with, for example, a solvent like dimethylformamide (DMF). The precursor obtained can be identified as chlorogallium phthalocyanine Type I on the basis of its XRPD trace. Thereafter, the precursor is subjected to hydrolysis by heating in the presence of a strong acid like sulfuric acid, and subsequently reprecipitating the dissolved pigment by mixing with a basic solution like ammonium hydroxide, and isolating the resulting pigment, which can be identified as Type I hydroxygallium phthalocyanine on the basis of its XRPD trace. The obtained Type I is then converted to Type V hydroxygallium phthalocyanine by adding thereto a solvent component like N,N-dimethylformamide, and subsequently stirring or alternatively milling in a closed container on an appropriate instrument, for example a ball mill, at room temperature, approximately 25° C., for a period of from about 8 hours to 1 week, and preferably about 24 hours. The pigment precursor Type I chlorogallium phthalocyanine can be prepared by the reaction of gallium chloride in a solvent, such as N-methylpyrrolidone, present in an amount of from about 10 parts to about 100 parts, and preferably about 19 parts, with 1,3-diiminoisoindolene in an amount of from about 1 part to about 10 parts, and preferably about 4 parts of DI for each part of gallium chloride that is reacted, and wherein in embodiments the reaction is accomplished by heating at, for example, about 200° C. When the resulting pigment precursor chlorogallium phthalocyanine Type I is hydrolyzed by, for example acid pasting, whereby the pigment precursor is dissolved in concentrated sulfuric acid and then reprecipitated in a solvent, such as water, or a dilute ammonia solution, for example from about 10 to about 15 percent, the hydrolyzed pigment contains very low levels of residual chlorine of from about 0.001 percent to about 0.1 percent, and in embodiments of from about 0.03 percent of the weight of the Type I hydroxygallium phthalocyanine pigment, as determined by elemental analysis.

The hydroxygallium phthalocyanine Type V can be formed from the Type I hydroxygallium phthalocyanine in the presence of a silanol. The reaction of 1 part of gallium chloride with from about 3 parts to about 12 parts, and more specifically, about 5 parts of 1,3-diiminoisoindolene in a solvent, such as N-methyl pyrrolidone, in an amount of from about 10 parts to about 100 parts, and more specifically, about 19 parts, for each part of gallium chloride that is used, provides a crude Type I chlorogallium phthalocyanine, which is subsequently washed with a component such as dimethylformamide to provide a pure form of Type I chlorogallium phthalocyanine as determined by X-ray powder diffraction; then dissolving 1 weight part of the resulting chlorogallium phthalocyanine in concentrated, about 94 percent, sulfuric acid in an amount of from about 1 weight part to about 100 weight parts, and in an embodiment about 5 weight parts, by stirring the pigment in the acid for an effective period of time, from about 1 hour to about 20 hours, and in an embodiment about 2 hours at a temperature of from about 0° C. to about 75° C., and more specifically, about 40° C. in air or under an inert atmosphere, such as argon or nitrogen; adding the resulting mixture to a stirred organic solvent in a dropwise manner at a rate of about 0.5 milliliter per minute to about 10 milliliters per minute, and in an embodiment about 1 milliliter per minute to a nonsolvent, which can be a mixture comprised of from about 1 volume part to about 10 volume parts, and more specifically, about 4 volume parts of concentrated aqueous ammonia solution (14.8 N) and from about 1 volume part to about 10 volume parts, and more specifically, about 7 volume parts of water, for each volume part of sulfuric acid that was used, which solvent mixture was chilled to a temperature of from about −25° C. to about 10° C., and in an embodiment about −5° C. while being stirred at a rate sufficient to create a vortex extending to the bottom of the flask containing the solvent mixture; isolating the resulting blue pigment by, for example, filtration; and washing the hydroxygallium phthalocyanine product obtained with deionized water by redispersing and filtering from portions of deionized water, which portions are from about 10 volume parts to about 400 volume parts, and in an embodiment about 200 volume parts for each weight part of the precursor pigment chlorogallium phthalocyanine Type I. The product, a dark blue solid, was confirmed to be Type I hydroxygallium phthalocyanine on the basis of its X-ray powder diffraction pattern having major peaks at 6.9, 13.1, 16.4, 21.0, 26.4, and the highest peak at 6.9 degrees 2θ. The Type I hydroxygallium phthalocyanine product obtained can then be treated in the presence of a silanol with an organic solvent, such as N,N-dimethylformamide, by, for example, ball milling the Type I hydroxygallium phthalocyanine pigment/silanol mixture in the presence of spherical glass beads, approximately 1 millimeter to 5 millimeters in diameter, at room temperature, about 25° C., for a period of from about 12 hours to about 1 week, and more specifically, about 24 hours to obtain silanol-modified hydroxygallium phthalocyanine Type V in a purity of up to about 99.5 percent, and with minimal chlorine content.

For the preparation of the precursor Type I chlorogallium phthalocyanine, the process in embodiments comprises the reaction by heating of 1 part gallium chloride with from about 1 part to about 10 parts, and more specifically, about 4 parts of $DI^3$ (1,3-diiminoisoindolene) in the presence of N-methylpyrrolidone solvent in an amount of from about 10 parts to about 100 parts, and more specifically, about 19 parts, whereby there is obtained a crude chlorogallium phthalocyanine Type I, which is subsequently purified, up to about a 99.5 percent purity, by washing with, for example, hot dimethylformamide at a temperature of from about 70° C. to about 150° C., and more specifically, about 150° C. in an amount of from about 2 to about 10, and more specifically, about 4 times the volume of the solid being washed.

In embodiments, the process comprises 1) the addition of 1 part of gallium chloride to a stirred solvent of N-methylpyrrolidone present in an amount of from about 0.10 parts to about 100 parts, and more specifically, about 19 parts with from about 1 part to about 10 parts, and more specifically, about 4 parts of 1,3-diiminoisoindolene; 2) relatively slow application of heat using an appropriate sized heating mantle at a rate of about 1 degree per minute to about 10 degrees per minute, and more specifically, about 5 degrees per minute until refluxing occurs at a temperature of about 200° C.; 3) continued stirring at the reflux temperature for a period of about 0.5 hour to about 8 hours, and more specifically, about 4 hours; 4) cooling of the reactants to a temperature of about 130° C. to about 180° C., and more specifically, about 160° C. by removal of the heat source; 5) filtration of the flask contents through, for example, an M-porosity sintered glass funnel which was preheated using a solvent which is capable of raising the temperature of the funnel to about 150° C., for example, boiling N,N-dimethylformamide in an amount sufficient to completely cover the resulting purple solid by slurrying the solid in portions of boiling DMF either in the funnel or in a separate vessel in a ratio of about 1 to about 10, and more specifically, about 3 times the volume of the solid being washed until the hot filtrate became light blue in color; 7) cooling and further washing the solid of impurities by slurrying the solid in several portions of N,N-dimethylformamide at room temperature, about 25° C., approximately equivalent to about three times the volume of the solid being washed until the filtrate became light blue in color; 8) washing the solid of impurities by slurrying in portions of an organic solvent, such as methanol, acetone, water and the like, and in an embodiment methanol, at room temperature, about 25° C., approximately equivalent to about three times the volume of the solid being washed until the filtrate became light blue in color; 9) oven drying the solid in the presence of a vacuum or in air at a temperature of from about 25° C. to about 200° C., and more specifically, about 70° C. for a period of from about 2 hours to about 48 hours, and more specifically, about 24 hours thereby resulting in the isolation of a shiny purple solid which was identified as being Type I chlorogallium phthalocyanine by its X-ray powder diffraction trace, having major peaks at 9.1, 11.0, 18.8, 20.3, and the highest peak at 27 degrees 2θ. The Type I chlorogallium phthalocyanine can then be converted to the corresponding hydroxygallium phthalocyanine as illustrated herein, and then subsequently converting the Type I hydroxygallium phthalocyanine into Type V hydroxygallium phthalocyanine in the presence of a silanol.

Also, in embodiments there can be selected for the processes illustrated herein, and wherein, for example, hydroxygallium Type V, essentially free of chlorine, can be obtained by selecting a mixture of $DI^3$ and phthalonitrile in place of $DI^3$ alone. More specifically, the pigment precursor chlorogallium phthalocyanine Type I can be prepared by reaction of 1 part gallium chloride with a mixture comprised of from about 0.1 part to about 10 parts, and more specifically, about 1 part of $DI^3$ (1,3-diiminoisoindolene), and from about 0.1 part to about 10 parts, and more specifically, about 3 parts of o-phthalonitrile in the presence of N-methyl pyrrolidone solvent, in an amount of from about 10 parts to about 100 parts, and more specifically, about 19 parts. The resulting pigment was identified as being Type I chlorogallium phthalocyanine by its X-ray powder diffraction trace having major peaks at 9.1, 11.0, 18.8, 20.3, and the highest peak at 27 degrees 2θ. When this pigment precursor is hydrolyzed by, for example, acid pasting whereby the pigment precursor is dissolved in concentrated sulfuric acid and then reprecipitated in a solvent, such as water, or a dilute ammonia solution, for example from about 10 to about 15 percent, the hydrolyzed Type V pigment contains very low levels of residual chlorine. It is believed that impurities, such as chlorine, in the photogenerating material can cause a reduction in the xerographic performance, and in particular, increased levels of dark decay and a negative impact on the cycling performance of layered photoconductive imaging members thereof.

In embodiments, the processes for the preparation of hydroxygallium phthalocyanine Type V comprise the reaction of 1 part of gallium chloride with a mixture comprised of from about 1 part to about 12 parts, and more specifically, about 1 part of 1,3-diiminoisoindolene, and from about 0.1 part to about 10 parts and more specifically, about 3 parts of o-phthalonitrile in a solvent, such as N-methyl pyrrolidone, present in an amount of from about 10 parts to about 100 parts, and more specifically, about 19 parts for each part of gallium chloride that is used to provide crude Type I chlorogallium phthalocyanine, which is subsequently washed with a component, such as hot dimethylformamide, by slurrying this crude solid in portions of DMF at a temperature of from about 75° C. to about 150° C., and preferably about 150° C. either in a funnel or in a separate vessel in a ratio of about 1 to about 10, and more specifically, about 3 times the volume of the solid being washed until the hot filtrate became light blue in color to provide a pure form of chlorogallium phthalocyanine Type I as determined by X-ray powder diffraction; dissolving the resulting chlorogallium phthalocyanine Type I in concentrated sulfuric acid in an amount of from about 1 weight part to about 100 weight parts, and in an embodiment about 5 weight parts of concentrated, about 94 percent, sulfuric acid by stirring the Type I pigment in the acid for an effective period of time, from about 30 seconds to about 24 hours, and in an embodiment, about 2 hours at a temperature of from about 0° C. to about 75° C., and more specifically, about 40° C. in air or under an inert atmosphere, such as argon or nitrogen; adding the dissolved precursor pigment chlorogallium phthalocyanine Type I in a dropwise manner at a rate of about 0.5 milliliter per minute to about 10 milliliters per minute, and in an embodiment, about 1 milliliter per minute to a solvent mixture which enables reprecipitation of the dissolved pigment, which solvent can be a mixture comprised of from about 3 volume part to about 10 volume parts, and more specifically, about 4 volume parts of concentrated aqueous ammonia solution (14.8 N), and from about 1 volume part to about 10 volume parts, and more specifically, about 7 volume parts of water for each volume part of sulfuric acid that was used, which solvent mixture was chilled to a temperature of from about −25° C. to about 10° C., and in an embodiment, about −5° C. while being stirred at a rate sufficient to create a vortex extending to the bottom of the flask containing said solvent mixture; filtering the dark blue suspension through a glass fiber filter fitted in a porcelain funnel; washing the isolated solid by redispersing in water by stirring for a period of from about 1 minute to about 24 hours, and in an embodiment, about 1 hour in an amount of from about 10 volume parts to about 400 volume parts, and in an embodiment, about 200 volume parts relative to the original weight of the solid Type I pigment used, followed by filtration as illustrated herein, until the conductivity of the filtrate was measured as less than 20 μS; and drying the resulting blue pigment in air or in the presence of a vacuum at a temperature of from about 25° C. to about 200° C., and in an embodiment, in air at about 70° C. for a period of from about 5 minutes to about 48 hours, and in an embodiment, about 12 hours to afford a dark blue powder in a desirable yield of from about 80 percent to about 99 percent, and in an embodiment, about 97 percent, which has been identified as being Type I hydroxygallium phthalocyanine on the basis of its XRPD spectrum, having major peaks at 6.9, 13.1, 16.4, 21.0, 26.4, and the highest peak at 6.9 degrees 2θ. The Type I hydroxygallium phthalocyanine product so obtained can then be treated with a silanol and a solvent, such as N,N-dimethylformamide, present in an amount of from about 1 volume part to about 40 volume parts, and more specifically, about 15 volume parts for each weight part of pigment hydroxygallium phthalocyanine that is used by, for example, ball milling the Type. I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours, such that there is obtained a silanol-modified hydroxygallium phthalocyanine Type V in a purity of from about 95 to about 99.5 percent, and with minimal chlorine.

In another embodiment, the process comprises 1) the addition of 3 parts of gallium chloride to the stirred solvent N-methylpyrrolidone present in an amount of from about 10 parts to about 100 parts, and more specifically, about 25 parts with from about 0.1 part to about 4 parts, and preferably about 1 part of 1,3-diiminoisoindolene, and from about 0.1 part to about 4 parts, and more specifically, about 3 parts of o-phthalonitrile, such that the combination of the latter two reagents totals about 4 parts for each part of gallium chloride that is used; 2) relatively slow, but steady application of heat using an appropriately sized heating mantle at a rate of about 1 degree per minute to about 10 degrees per minute, and more specifically, about 5 degrees per minute until refluxing occurs at a temperature of about 200° C.; 3) continued stirring at said reflux temperature for a period of about 1 hour to about 5 hours, and more specifically, about 5 hours; 4) cooling of the reactants to a temperature of about 130° C. to about 180° C., and more specifically, about 160° C. by removal of the heat source; 5) filtration of the flask contents through, for example, an M-porosity (10 to 15 μm) sintered glass funnel, which was preheated using a solvent which is capable of raising the temperature of the funnel to about 150° C., for example, boiling N,N-dimethylformamide in an amount sufficient to completely cover the bottom of the filter funnel so as to prevent blockage of the funnel; 6) washing the resulting purple solid by slurrying the solid in portions of boiling DMF either in the funnel or in a separate vessel in a ratio of about 1 to about 10, and more specifically, about 3 times the volume of the solid being washed until the hot filtrate became light blue in color; 7) cooling and further washing the solid of impurities by slurrying the solid in several portions of N,N-dimethylformamide at room temperature, about 25° C., approximately equivalent to about three times the volume of the solid being washed until the filtrate became light blue in color; 8) washing the solid of impurities by slurrying in several portions of an organic solvent, such as methanol, acetone, water, mixtures thereof, and the like, and in an embodiment, methanol at room temperature, about 25° C., approximately equivalent to about three times the volume of the solid being washed until the filtrate became light blue in color; and 9) oven drying the solid in the presence of a vacuum or in air at a temperature of from about 25° C. to about 200° C., and more specifically, about 70° C. for a period of from about 2 hours to about 48 hours, and more specifically, about 24 hours thereby resulting in the isolation of a shiny purple solid which was identified as being Type I chlorogallium phthalocyanine by its X-ray powder diffraction trace with major peaks at 9.1, 11.0, 18.8, 20.3, and the highest peak at 27 degrees 2θ. This particular embodiment can result in a cost savings of $1,000 per kilogram of chlorogallium phthalocyanine Type I that is realized.

The Type I chlorogallium phthalocyanine obtained can then be converted to Type I hydroxygallium phthalocyanine by the dissolution thereof in concentrated sulfuric acid, and thereafter reprecipitating the product obtained in a solvent mixture of, for example, an aqueous ammonia solution. In a specific embodiment, the Type I chlorogallium phthalocyanine obtained can be converted to Type I hydroxygallium phthalocyanine by 1) dissolving 1 weight part of the Type I chlorogallium phthalocyanine pigment in a ratio of from about 1 weight part to about 100 weight parts, and in an embodiment, about 6 weight parts of concentrated, about 94 percent, sulfuric acid by stirring the pigment in the acid for an effective period of time, from about 10 minutes to about 7 hours, and in an embodiment, about 2 hours at a temperature of from about 0° C. to about 75° C., and more specifically, about 40° C. in air or under an inert atmosphere such as argon or nitrogen; 2) reprecipitating the dissolved Type I chlorogallium phthalocyanine pigment by adding the dissolved solution in a dropwise manner at a rate of about 0.5 milliliter per minute to about 10 milliliters per minute, and in an embodiment, about 1 milliliter per minute to a nonsolvent, which can be a mixture comprised of from about 1 volume part to about 10 volume parts, and more specifically, about 4 volume parts of a concentrated aqueous ammonia solution (14.8 N) and from about 1 volume part to about 10 volume parts, and more specifically, about 7 volume parts of water for each volume part of sulfuric acid that was used, which solvent mixture was chilled to a temperature of from about −25° C. to about 10° C., and in an embodiment, about −5° C. while being stirred at a rate sufficient to create a vortex extending to the bottom of the flask containing said solvent mixture; 3) filtering the dark blue suspension through a glass fiber filter fitted in a porcelain funnel; 4) washing the isolated solid by redispersing in water by stirring for a period of from about 1 minute to about 24 hours, and in an embodiment, about 1 hour in an amount of from about 10 volume parts to about 400 volume parts, and in an embodiment, about 200 volume parts relative to the original weight of the solid Type I pigment used, followed by filtration as illustrated herein; 5) repeating steps 3 and 4 until the conductivity of the filtrate was measured as less than about 20 μS, and more specifically, about 18 μS; and 6) drying the resulting blue pigment in air or in the presence of a vacuum at a temperature of from about 25° C. to about 200° C., and in an embodiment, in air at about 70° C. for a period of from about 5 minutes to about 48 hours, and in an embodiment, about 10 hours to afford a dark blue powder in a desirable yield of from about 75 percent to about 99 percent, and in an embodiment, about 97 percent, which has been identified as being Type I hydroxygallium phthalocyanine on the basis of its XRPD spectrum having major peaks at 6.9, 13.1, 16.4, 21.0, 26.4, and the highest peak at 6.9 degrees 2θ. The aforementioned Type I hydroxygallium phthalocyanine, which particles were found to be very small, from about 0.01 μm to about 0.1 μm, and in an embodiment, about 0.03 μm in diameter, can be selected as a photogenerator for use in a layered photoconductive device or imaging member, or can be utilized as an intermediate for the conversion thereof to Type V hydroxygallium phthalocyanine by the treatment thereof with a solvent, such as N,N-dimethylformamide by, for example, ball milling the Type I hydroxygallium phthalocyanine pigment in the presence of a silanol and spherical glass beads, approximately 1 millimeter to 5 millimeters in diameter, at room temperature, about 25° C., for a period of from about 12 hours to about 1 week, and more specifically, about 18 hours.

The Type I hydroxygallium phthalocyanine obtained can be treated by, for example, ball milling the Type I hydroxygallium phthalocyanine pigment in a suitable solvent, for example N,N-dimethylformamide, present in an amount of from about 10 volume parts to about 50 volume parts, and more specifically, about 12 volume parts for each weight part of pigment, hydroxygallium phthalocyanine Type I, that is used in the presence of spherical glass beads, approximately 1 millimeter to 5 millimeters in diameter, at room temperature, about 25° C., for a period of from about 12 hours to about 1 week, and more specifically, about 24 hours to provide Type V hydroxygallium phthalocyanine having exceptionally low levels of chlorine of from about 0.001 percent to about 0.1 percent, and in an embodiment, about 0.01 percent of the weight of the Type V hydroxygallium pigment, as determined by elemental analysis, when the precursor pigment chlorogallium phthalocyanine Type I was prepared using 1 part of gallium chloride and from about 1 part to about 10 parts, and more specifically, about 4 parts of $DI^3$ in about 23 parts of N-methylpyrrolidone as reagents.

Examples of silanols include POSS silanols wherein throughout POSS refers to polyhedral oligomeric silsesquioxane silanols. Examples of POSS silanols can be selected from a group consisting of isobutyl-POSS cyclohexenyl dimethylsilyldisilanol or isobutyl-polyhedral oligomeric silsesquioxane cyclohexenyl dimethylsilyldisilanol ($C_{38}H_{84}O_{12}Si_8$), cyclopentyl-POSS dimethylphenyldisilanol ($C_{43}H_{76}O_{12}Si_8$), cyclohexyl-POSS dimethylvinyldisilanol ($C_{46}H_{88}O_{12}Si_8$), cyclopentyl-POSS dimethylvinyldisilanol ($C_{39}H_{74}O_{12}Si_8$), isobutyl-POSS dimethylvinyldisilanol ($C_{32}H_{74}O_{12}Si_8$), cyclopentyl-POSS disilanol ($C_{40}H_{74}O_{13}Si_8$), isobutyl-POSS disilanol ($C_{32}H_{74}O_{13}Si_8$), isobutyl-POSS epoxycyclohexyldisilanol ($C_{38}H_{84}O_{13}Si_8$), cyclopentyl-POSS fluoro(3)disilanol ($C_{40}H_{75}F_3O_{12}Si_8$), cyclopentyl-POSS fluoro(13)disilanol ($C_{45}H_{75}F_{13}O_{12}Si_8$), isobutyl-POSS fluoro(13)disilanol ($C_{38}H_{75}F_{13}O_{12}Si_8$), cyclohexyl-POSS methacryldisilanol ($C_{51}H_{96}O_{14}Si_8$), cyclopentyl-POSS methacryldisilanol ($C_{44}H_{82}O_{14}Si_8$), isobutyl-POSS methacryldisilanol ($C_{37}H_{82}O_{14}Si_8$), cyclohexyl-POSS monosilanol ($C_{42}H_{78}O_{13}Si_8$), cyclopentyl-POSS monosilanol (Schwabinol, $C_{35}H_{64}O_{13}Si_8$), isobutyl-POSS monosilanol ($C_{28}H_{64}O_{13}Si_8$), cyclohexyl-POSS norbornenylethyldisilanol ($C_{53}H_{98}O_{12}Si_8$), cyclopentyl-POSS norbornenylethyldisilanol ($C_{46}H_{84}O_{12}Si_8$), isobutyl-POSS norbornenylethyldisilanol ($C_{39}H_{84}O_{12}Si_8$), cyclohexyl-POSS TMS disilanol ($C_{45}H_{88}O_{12}Si_8$), isobutyl-POSS TMS disilanol ($C_{31}H_{74}O_{12}Si_8$), cyclohexyl-POSS trisilanol ($C_{42}H_{80}O_{12}Si_7$), cyclopentyl-POSS trisilanol ($C_{35}H_{66}O_{12}Si_7$), isobutyl-POSS trisilanol ($C_{28}H_{66}O_{12}Si_7$), isooctyl-POSS trisilanol ($C_{56}H_{122}O_{12}Si_7$), phenyl-POSS trisilanol ($C_{42}H_{38}O_{12}Si_7$), and the like, and mixtures thereof, all commercially available from Hybrid Plastics, Fountain Valley, Calif. In embodiments, the POSS silanol is a phenyl-POSS trisilanol, or phenyl-polyhedral oligomeric silsesquioxane trisilanol of the following formula/structure

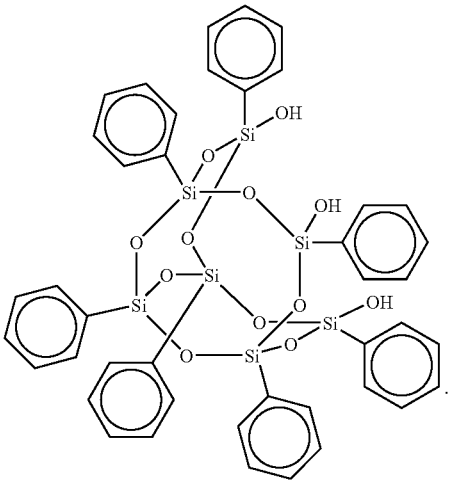

The POSS silanol can contain from about 7 to about 20 silicon atoms, or from about 7 to about 12 silicon atoms. The $M_w$ of the POSS silanol is, for example, from about 700 to about 2,000, or from about 800 to about 1,300.

In embodiments, silanols that can be selected are free of POSS. Examples of such silanols include dimethyl(thien-2-yl)silanol, tris(isopropoxy)silanol, tris(tert-butoxy)silanol, tris(tert-pentoxy)silanol, tris(o-tolyl)silanol, tris(1-naphthyl)silanol, tris(2,4,6-trimethylphenyl)silanol, tris(2-methoxyphenyl)silanol, tris(4-(dimethylamino)phenyl)silanol, tris(4-biphenylyl)silanol, tris(trimethylsilyl)silanol, dicyclohexyltetrasilanol ($C_{12}H_{26}O_5Si_2$), mixtures thereof, and the like, and yet more specifically,

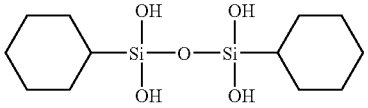

-continued

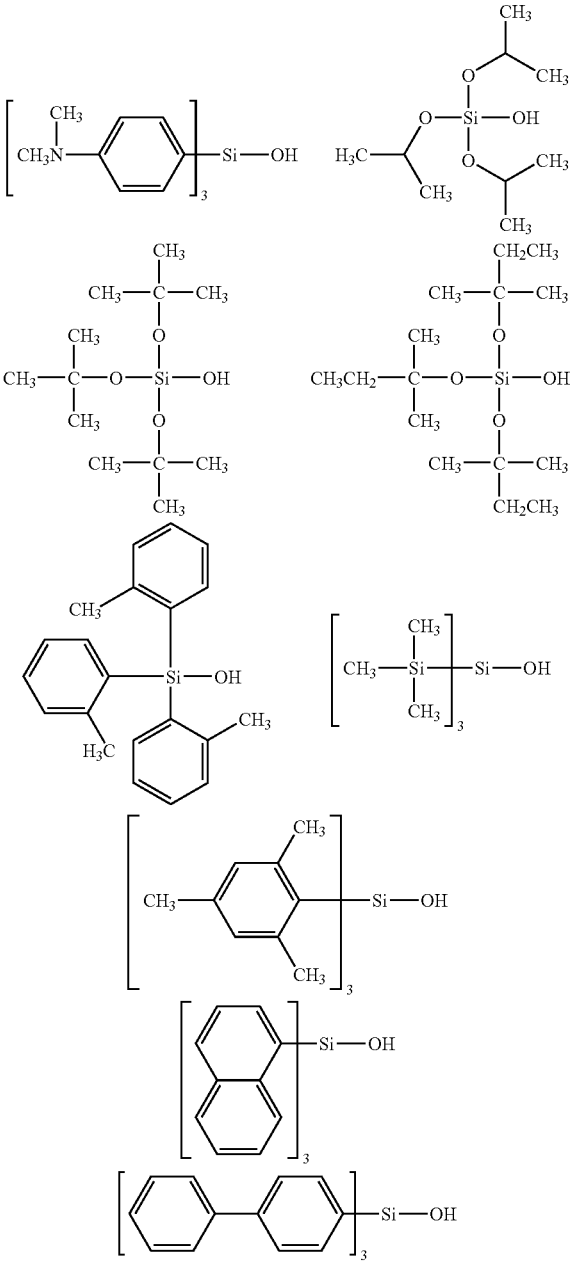

The silanols selected for the members, devices, and photoconductors illustrated herein are stable primarily in view of the Si—OH substituents in that these substituents eliminate water to form siloxanes, which are Si—O—Si linkages. While not being limited by theory, it is believed that in view of the silanol hindered structures at the other three bonds attached to the silicon are stable for extended time periods, such as from at least one week to over one year. The silanols can be included in the charge transport layer solution or dispersion, or the photogenerating layer solution or dispersion, that is, for example, dissolved therein, or alternatively the silanols can be added to the charge transport and/or the photogenerating layer.

Various suitable amounts of the silanols can be selected, such as from about 0.01 to about 50 percent by weight of solids throughout, or from about 0.1 to about 30 percent by weight, or from about 1 to about 10 percent by weight of the hydroxygallium phthalocyanine pigment. The silanols can be dissolved in the charge transport layer solution/dispersion and the photogenerating layer solution/dispersion, or alternatively the silanol can simply be added to the formed charge transport layer and/or the formed photogenerating layer. In embodiments, the silanol is included in the known conversion process when preparing the Type V hydroxygallium phthalocyanine.

For the photogenerating layer, although not desiring to be limited by theory, it is believed that the photogenerating pigment is modified with a hydrophobic moiety by the in situ attachment of a hydrophobic silanol onto the photogenerating pigment surface with the remainder of the silanol interacting with the resin binder thereby enabling the pigment to be readily dispersible during the dispersion milling process.

The thickness of the substrate layer depends on many factors, including economical considerations, electrical characteristics, and the like, thus this layer may be of a substantial thickness, for example over 3,000 microns, such as from about 300 to about 700 microns, or of a minimum thickness. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In some situations, it may be desirable to coat on the back of the substrate, particularly when the substrate is a flexible organic polymeric material, an anticurl layer, such as for example polycarbonate materials commercially available as MAKROLON®.

The photogenerating pigment Type V can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts of, for example, from about 10 to about 90 weight percent, and more specifically, from about 30 to about 70 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, ethers, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The Type V photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 70 percent by weight of the photogenerating pigment is dispersed in about 80 percent by weight to about 30 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.4 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micron (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), phenolic-formaldehyde resins, melamine-formaldehyde resins, poly(vinyl alcohol), polyurethane, and polyacrylonitrile. This layer is, for example, of a thickness of from about 0.001 micron to about 10 microns, or from about 0.1 micron to about 2 microns. Optionally, this layer may contain effective suitable amounts, for example from about 1 to about 80 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, a metal oxide like titanium, chromium, zinc, tin oxides, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene) bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

Charge transport components and molecules include a number of known materials, such as aryl amines, which layer is generally of a thickness of from about 5 microns to about 75 microns, and more specifically, of a thickness of from about 10 microns to about 40 microns, include molecules of the following formula

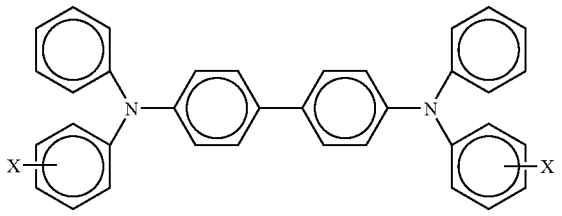

wherein X is alkyl, alkoxy, aryl, a halogen, or mixtures thereof, and especially those substituents selected from the group consisting of Cl and $CH_3$; and molecules of the following formula

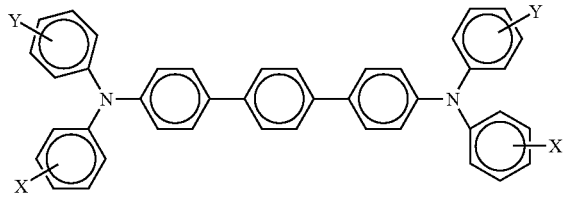

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 5 to about 75 microns, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The overcoat or top charge transport layer can comprise the same components as the charge transport layer wherein the weight ratio between the charge transporting small molecules, and the suitable electrically inactive resin binder is less, such as for example, from about 0/100 to about 60/40, or from about 20/80 to about 40/60.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. Also, parts and percentages are by weight unless otherwise indicated. A Comparative Example and data are also presented.

Synthesis Comparative Example 1

Synthesis of Type I Chlorogallium Phthalocyanine:

A 250 milliliter three-necked flask fitted with a mechanical stirrer, condenser and thermometer maintained under an atmosphere of argon was charged with 1,3-diiminoisoindolene (16 grams, 0.11 mole), gallium chloride (5 grams, 0.0284 mole; available from Aldrich Chemical) and 50 milliliters of N-methylpyrrolidone (available from Aldrich Chemical). The resulting mixture was heated and stirred at reflux (202° C.) for 2 hours. The product was cooled to about 150° C., and filtered through a 150 milliliter M-porosity sintered glass funnel which was preheated to approximately 150° C. with boiling N,N-dimethylformamide (DMF), and then washed thoroughly with three portions of 75 milliliters of boiling DMF, followed by three portions of 75 milliliters of DMF at room temperature, and then three portions of 50 milliliters of methanol, thus providing 7 grams (41 percent yield) of shiny purple crystals. X-ray powder diffraction patterns for this intermediate Type I chlorogallium phthalocyanine, hydroxygallium phthalocyanine Type I.

Hydrolysis of the above-obtained precursor was accomplished as follows. Sulfuric acid (125 grams) was heated to 40° C. in a 125 milliliter Erlenmeyer flask. To the heated acid were added 5 grams of the purple crystal pigment precursor chlorogallium phthalocyanine Type I prepared as described in Comparative Example 1. Addition of the solid was completed over a period of approximately 15 minutes during which time the temperature of the solution increased to about 47° C. to about 48° C. The acid solution was then stirred for 2 hours at 40° C. at which time it was added in a dropwise fashion to a mixture comprised of concentrated (−33 percent) ammonia (265 milliliters) and deionized water (435 milliliters), which had been cooled to a temperature below 5° C. Addition of the dissolved pigment was completed over the course of approximately 30 minutes during which time the temperature of the solution increased to about 10° C. The reprecipitated pigment was then removed from the cooling bath, and allowed to stir at room temperature for 1 hour. The resulting pigment was then filtered through a porcelain funnel fitted with a Whatman 934-AH grade glass fiber filter. The resulting blue pigment was redispersed in fresh deionized water by stirring at room temperature for 1 hour, and filtered as before. This process was repeated three times until the conductivity of the filtrate was less than 20 μS. The filter cake was oven dried overnight at 50° C. to provide 4.75 grams (95 percent) of a dark blue solid, identified by X-ray diffraction as being Type I hydroxygallium phthalocyanine.

The obtained Type I above was then converted to Type V OHGaPc as follows. The pigment product Type I hydroxygallium phthalocyanine (3 grams) was added to 45 milliliters of N,N-dimethylformamide (BDH Assured) in a 120 milliliter glass bottle containing 90 grams of glass beads (1 millimeters diameter). The bottle was sealed and placed on a ball mill for 5 days. The resulting solid was isolated by filtration through a porcelain funnel fitted with a Whatman GF/F grade glass fiber filter, and washed in the filter using five portions of n-butyl acetate (50 milliliters) (BDH Assured). The filter cake obtained was oven dried overnight, about 18 hours, at 50° C. to provide 2.8 grams (93 percent) of a dark blue solid, which was identified as Type V hydroxygallium phthalocyanine by XRPD with major peaks at 7.4, 9.8, 12.4, 16.2, 17.6, 18.4, 21.9, 23.9, 25.0, 28.1, and the highest peak at 7.4 degrees 2θ.

Synthesis Example I

A hydroxygallium phthalocyanine pigment was prepared by repeating the process of Synthesis Comparative Example 1 except that in the conversion process from Type I to Type V, the pigment product Type I hydroxygallium phthalocyanine (3 grams) was added to 45 milliliters of N,N-dimethylformamide (BDH Assured) in a 120 milliliter glass bottle containing 90 grams of glass beads (1 millimeter diameter). The bottle was sealed and placed on a ball mill for 4 days. Then, 0.15 gram of trisilanolphenyl POSS material (SO1458 from Hybrid Plastics, Fountain Valley, Calif.) was added into the conversion mixture, and milled for another day. The resulting solid was isolated by filtration through a porcelain funnel fitted with a Whatman GF/F grade glass fiber filter, and washed in the filter using five portions of n-butyl acetate (50 milliliters) (BDH Assured). The filter cake was oven dried overnight, about 18 hours, at 50° C. to provide 2.8 grams (93 percent) of a dark blue solid, which was identified as a silanol-modified hydroxygallium phthalocyanine Type V by XRPD with major peaks at 7.4, 9.8, 12.4, 16.2, 17.6, 18.4, 21.9, 23.9, 25.0, 28.1, and the highest peak at 7.4 degrees 2θ, and where the silanol was contained in the Type V pigment. The XRPD spectrum of the silanol-modified hydroxygallium phthalocyanine Type V (Synthesis Example I) was almost identical to that of the hydroxygallium phthalocyanine Type V (Synthesis Comparative Example 1).

NMR spectrum showed there was 1 weight percent of the silanol present in the silanol-modified hydroxygallium phthalocyanine Type V (Synthesis Example I), noting the initial weight/weight ratio of the silanol/hydroxygallium phthalocyanine was equal to 5/100 in the conversion. About 1 weight percent of the silanol was bonded to the Type V pigment, while the remaining 4 weight percent of the silanol was removed during washing.

Comparative Example 2

A multilayered photoreceptor of the rigid drum design was fabricated by conventional coating technology with an aluminum drum of 34 millimeters in diameter as the substrate. The undercoat layer was comprised of three components generated from a coating solution prepared as follows. Zirconium acetylacetonate tributoxide (35.5 parts), γ-aminopropyltriethoxysilane (4.8 parts), and poly(vinyl butyral) BM-S (2.5 parts) were dissolved in n-butanol (52.2 parts). The coating solution was coated on the aluminum drum via a ring coater, and the layer resulting was preheated at 59° C. for 13 minutes, humidified at 58° C. (dew point=54° C.) for 17 minutes, and dried at 135° C. for 8 minutes. The thickness of the undercoat layer was approximately 1.3 μm.

The photogenerating layer was generated from a coating dispersion prepared as follows. 2.7 Grams of HOGaPc Type V pigment (Synthesis Comparative Example 1) were mixed with about 2.3 grams of the polymeric binder, polyvinyl chloride-co-vinyl acetate-co-maleic acid, VMCH (Dow Chemical, Midland, Mich.), and 45 grams of n-butyl acetate. The mixture was milled in an attritor mill with about 200 grams of 1 millimeter Hi-Bea borosilicate glass beads for about 3 hours. The dispersion was filtered through a 20 μm nylon cloth filter, and the solid content of the dispersion was diluted to about 5.8 weight percent. The HOGaPc photogenerating layer dispersion was applied on top of the above undercoat layer. The thickness of the photogenerating layer was approximately 0.2 μm.

Subsequently, a 15 micron charge transport layer was coated on top of the photogenerating layer, which coating solution was prepared by dissolving N,N'-diphenyl-N,N-bis (3-methylphenyl)-1,1'-biphenyl-4,4'-diamine (4 grams), and a film forming polymer binder PCZ 400 [poly(4,4'-dihydroxy-diphenyl-1-1-cyclohexane, $M_w$=40,000)], available from Mitsubishi Gas Chemical Company, Ltd. (6 grams) in 22.5 grams of tetrahydrofuran (THF) and 7.5 grams of monochlorobenzene. The charge transport layer was dried at about 135° C. for about 40 minutes.

Comparative Example 3

An imaging member or photoconductor was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator, and which adhesive layer contains 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) (Synthesis Comparative Example 1, no silanol) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

The resulting photoconductor web was then overcoated with a two-layer charge transport layer. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

Example II

A photoconductor was prepared by repeating the process of Comparative Example 1 except that the photogenerating layer contained the silanol-modified hydroxygallium phthalocyanine Type V, as obtained in the above Synthesis Example I.

Example III

A photoconductor was prepared by repeating the process of Comparative Example 2 except that the photogenerating layer contained the silanol-modified hydroxygallium phthalocyanine Type V, as obtained in the above Synthesis Example I.

Electrical Property Testing

The above prepared photoreceptor devices (Comparative Example 1 and Example I, Comparative Example 2 and Example II) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.).

In embodiments, there was almost no PIDC change between Comparative Example 1 and Example I (rigid drum devices), Comparative Example 2 and Example II (flexible belt devices). The silanol-modified hydroxygallium phthalocyanine pigment functioned like the controlled hydroxygallium phthalocyanine pigment electrically. The silanol modification did not adversely affect the electrical properties of the photogenerating pigment.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member. The method of U.S. Pat. No. 5,703,487, the disclosure of which is totally incorporated herein by reference, designated as field-induced dark decay (FIDD), involves measuring either the differential increase in charge over and above the capacitive value, or measuring reduction in voltage below the capacitive value of a known imaging member and of a virgin imaging member, and comparing differential increase in charge over and above the capacitive value, or the reduction in voltage below the capacitive value of the known imaging member and of the virgin imaging member.

U.S. Pat. Nos. 6,008,653 and 6,150,824, the disclosures of each patent being totally incorporated herein by reference, disclose a method for detecting surface potential charge patterns in an electrophotographic imaging member with a floating probe scanner. Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, and a floating fixture which maintains a substantially constant distance between the probe and the imaging surface. A constant voltage charge is applied to the imaging surface prior to relative movement of the probe and the imaging surface past each other, and the probe is synchronously biased to within about +/−300 volts of the average surface potential of the imaging surface to prevent breakdown, measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts is commonly chosen to count charge deficient spots. Two of the above prepared photoconductors (Comparative Example 2 and Example II) were measured for CDS counts using the above-described FPS technique, and the results follow in Table 1.

TABLE 1

| | CDS (Counts/cm$^2$) |
|---|---|
| Comparative Example 2 | 3.5 |
| Example II | 0.5 |

The above data demonstrated that the CDS for the photoconductor of Example II comprised of a photogenerating layer of the silanol-modified HOGaPc Type V was minimal, and more specifically, improved by over 85 percent as compared to the control Comparative Example 2.

Background Measurement

The above prepared photoconductor devices (Comparative Example 1 and Example I) were acclimated for 24 hours before testing at 85° F. and 80 percent humidity (A zone). Print testing was completed in a Xerox Corporation Copeland Work Centre Pro 3545 using 52 mm/second process speed. Background levels were measured against an empirical scale, which was judged by an experienced grader (from Grade 1 to Grade 7). The smaller the background grade, the better the print quality and the less background. The results follow in Table 2.

TABLE 2

| | Background Level |
|---|---|
| Comparative Example 1 | Grade 4 |
| Example I | Grade 3 |

The above data demonstrated that the background level for the photoconductor of Example I comprised of a photogenerating layer of the silanol-modified HOGaPc Type V was 1 grade lower than the Comparative Example 1 control.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and at least one charge transport layer comprised of at least one charge transport component, and wherein said photogenerating layer contains a Type V hydroxygallium phthalocyanine having incorporated therein a silanol.

2. A photoconductor comprising a substrate, a photogenerating layer, and at least one charge transport layer comprised of at least one charge transport component, and wherein said photogenerating layer contains a mixture of Type V hydroxygallium phthalocyanine and at least one silanol, and wherein said silanol is selected from the group comprised of the following formulas/structures

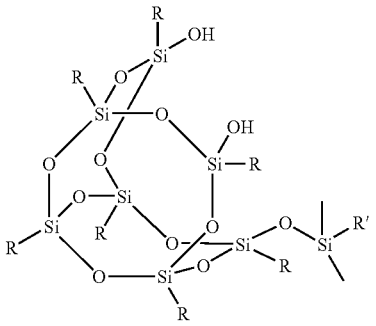

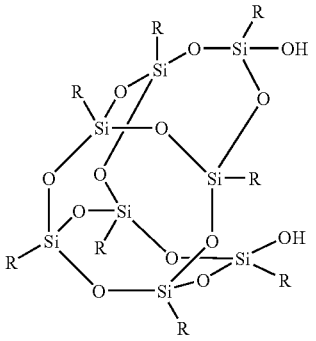

-continued

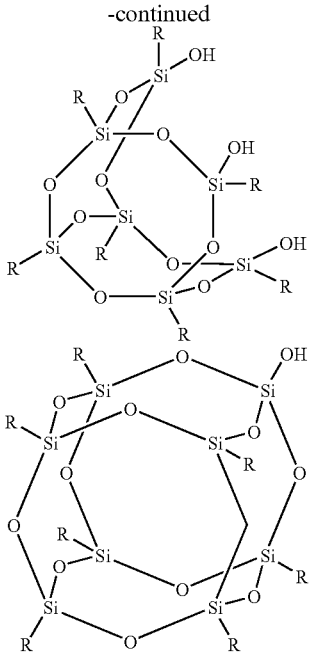

and wherein R and R' are independently selected from the group consisting of alkyl, alkoxy, aryl, and substituted derivatives thereof, and mixtures thereof.

3. A photoconductor in accordance with claim 2 wherein R and R' are phenyl, methyl, vinyl, allyl, isobutyl, isooctyl, cyclopentyl, cyclohexyl, cyclohexenyl-3-ethyl, epoxycyclohexyl-4-ethyl, fluorinated alkyl, methacrylolpropyl, or norbornenylethyl.

4. A photoconductor in accordance with claim 1 wherein said silanol is selected from at least one of the group comprised of dimethyl(thien-2-yl)silanol tris(isopropoxy)silanol, tris(tert-butoxy)silanol, tris(tert-pentoxy)silanol, tris(o-tolyl) silanol, tris(1-naphthyl)silanol, tris(2,4,6-trimethylphenyl) silanol, tris(2-methoxyphenyl)silanol, tris(4-(dimethylamino)phenyl)silanol, tris(4-biphenylyl)silanol, tris (trimethylsilyl) silanol, and dicyclohexyltetrasilanol.

5. A photoconductor in accordance with claim 2 wherein said charge transport component is comprised of aryl amines of the formulas

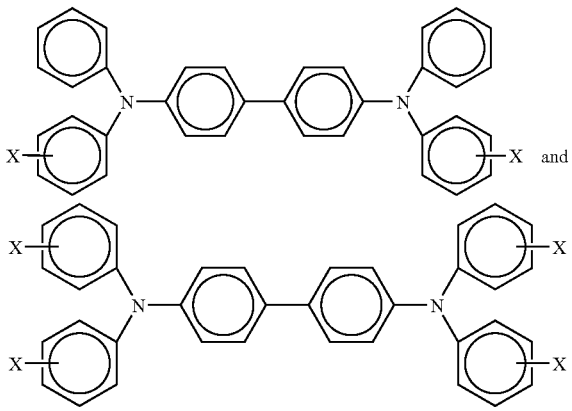

wherein X is selected from the group consisting of alkyl, alkoxy, aryl, and halogen.

6. A photoconductor in accordance with claim 5 wherein said alkyl and said alkoxy each contains from about 1 to about 12 carbon atoms, and said aryl contains from about 6 to about 36 carbon atoms; and wherein said R and R' alkyl and alkoxy contain from 1 to about 12 carbon atoms, and said aryl contains from 6 to about 36 carbon atoms.

7. A photoconductor in accordance with claim 5 wherein said aryl amine is N,N'-diphenyl-N,N-bis(3-methylphenyl)-1,1'-biphenyl-4,4'-diamine.

8. A photoconductor in accordance with claim 2 wherein said charge transport component is comprised of aryl amines of the formulas

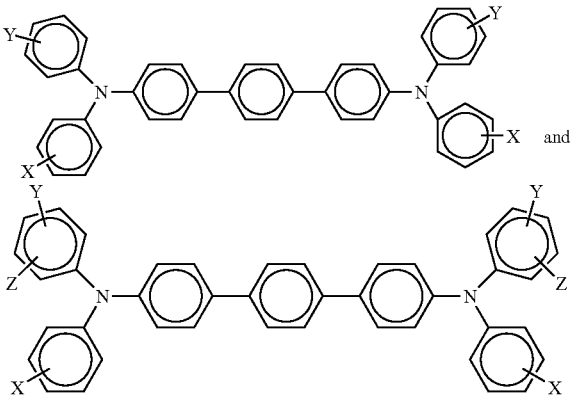

wherein X, Y and Z are independently selected from the group consisting of alkyl, alkoxy, aryl, and halogen.

9. A photoconductor in accordance with claim 8 wherein alkyl and alkoxy each contains from about 1 to about 12 carbon atoms, and aryl contains from about 6 to about 36 carbon atoms.

10. A photoconductor in accordance with claim 8 wherein said aryl amine is selected from at least one of the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and wherein said photoconductor further comprises a supporting substrate.

11. A photoconductor in accordance with claim 2 wherein said silanol is present in an amount of from about 0.1 to about 20 weight percent.

12. A photoconductor in accordance with claim 2 further including in at least one of said charge transport layers an antioxidant comprised of at least one of hindered phenolic and hindered amine.

13. A photoconductor in accordance with claim 2 wherein said photogenerating layer further contains a second photogenerating pigment or photogenerating pigments.

14. A photoconductor in accordance with claim 13 wherein said second photogenerating pigment is comprised of at least one of a metal phthalocyanine, a metal free phthalocyanine, a titanyl phthalocyanine, a halogallium phthalocyanine, an alkoxy gallium phthalocyanine, a perylene, or mixtures thereof.

15. A photoconductor in accordance with claim 2 wherein said mixture is comprised of from 80 to about 99.9 weight percent of said hydroxygallium phthalocyanine Type V, and said silanol is present in an amount of from about 0.1 to about 20 weight percent, and wherein the total thereof is 100 weight percent.

16. A photoconductor in accordance with claim 2 wherein said hydroxygallium phthalocyanine Type V is formed by the hydrolysis of a halogallium phthalocyanine or an alkoxy gallium phthalocyanine precursor to a hydroxygallium phthalocyanine, and conversion of the resulting hydroxygallium phthalocyanine to Type V hydroxygallium phthalocyanine by contacting said intermediate hydroxygallium phthalocyanine with an organic solvent, and which conversion is completed in the presence of said silanol.

17. A photoconductor in accordance with claim 16 wherein said hydroxygallium Type V is obtained by the hydrolysis of halogallium phthalocyanine Type I precursor to hydroxygallium phthalocyanine Type I, and conversion of the resulting hydroxygallium phthalocyanine Type I to Type V hydroxygallium phthalocyanine by contacting said hydroxygallium phthalocyanine Type I with an organic solvent of dimethylformamide, and which conversion is completed in the presence of said silanol, and wherein the precursor halogallium phthalocyanine Type I is obtained by the reaction of a gallium halide with a diiminoisoindolene in an organic solvent.

18. A photoconductor in accordance with claim 2 further including a hole blocking layer, and an adhesive layer.

19. A photoconductor in accordance with claim 2 wherein said silanol possesses a weight average molecular weight $M_w$ of from about 700 to about 2,000.

20. A photoconductor in accordance with claim 2 wherein said at least one charge transport layer is from 1 to about 7 layers, and said substrate is present.

21. A photoconductor in accordance with claim 2 wherein said at least one charge transport layer is from 1 to about 3 layers.

22. A photoconductor in accordance with claim 2 wherein said at least one charge transport layer is comprised of a top charge transport layer and a bottom charge transport layer, and wherein said top layer is in contact with said bottom layer and said bottom layer is in contact with said photogenerating layer.

23. A photoconductor in accordance with claim 22 wherein said top layer is comprised of a hole transport component, a resin binder, an antioxidant, and said bottom layer is comprised of at least one charge transport component, a resin binder, and an optional antioxidant.

24. A photoconductor in accordance with claim 2 wherein said silanol is present in an amount of from about 0.05 to about 3 weight percent.

25. A photoconductor in accordance with claim 2 wherein said silanol is present in an amount of from about 0.1 to about 5 weight percent.

26. A photoconductor comprised in sequence of a substrate, a photogenerating layer, and a charge transport layer, and wherein said photogenerating layer is comprised of a mixture of hydroxygallium phthalocyanine Type V and a silanol, wherein said hydroxygallium phthalocyanine Type V is formed by the hydrolysis of a halogallium phthalocyanine to a hydroxygallium phthalocyanine, and conversion of the resulting hydroxygallium phthalocyanine to Type V hydroxygallium phthalocyanine by contacting said hydroxygallium phthalocyanine intermediate with an organic solvent, and which conversion is completed in the presence of said silanol, and wherein said silanol is selected from the group comprised of

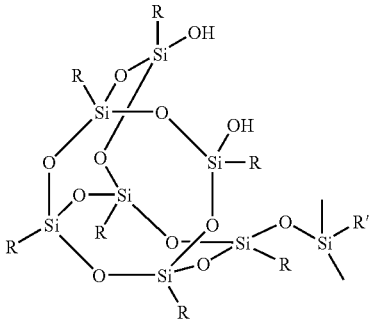

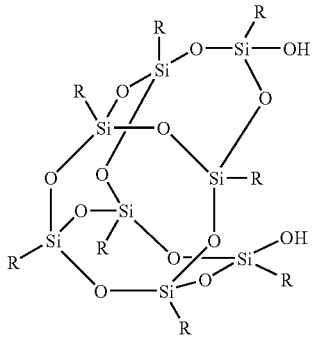

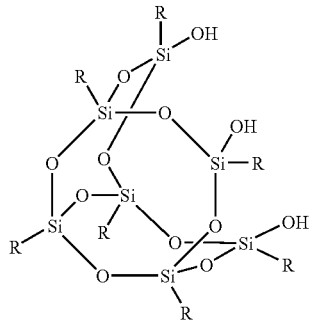

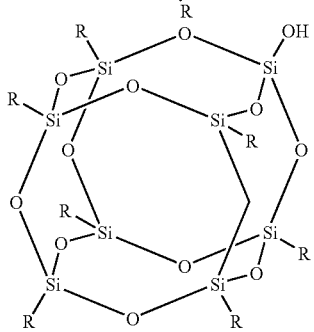

wherein R and R' are independently selected from the group consisting of alkyl, alkoxy, aryl, and substituted derivatives thereof, and mixtures thereof; and wherein said silanol is present in an amount of from about 0.1 to about 40 weight percent.

27. A photoconductor in accordance with claim 26 wherein said silanol is present in an amount of from 1 to about 5 weight percent, said hydrocarbon is alkyl and alkoxy, each containing from 1 to about 12 carbon atoms, and aryl containing from 6 to about 36 carbon atoms.

28. A photoconductor in accordance with claim 26 wherein said photogenerating layer is situated between said substrate and said charge transport layer.

29. A photoconductor in accordance with claim 1 wherein said Type V hydroxygallium phthalocyanine is prepared by the hydrolysis of a halogallium phthalocyanine to a hydroxygallium phthalocyanine intermediate, and conversion of the resulting hydroxygallium phthalocyanine to Type V hydroxygallium phthalocyanine by contacting said hydroxygallium phthalocyanine intermediate in the presence of said silanol with an organic solvent.

30. A photoconductor in accordance with claim 29 wherein said silanol caused silanation of the Type V surface resulting in a hydrophobic Type V hydroxygallium phthalocyanine.

* * * * *